US006881070B2

(12) United States Patent
Chiang

(10) Patent No.: US 6,881,070 B2
(45) Date of Patent: Apr. 19, 2005

(54) LGA CONNECTOR AND TERMINAL THEREOF

(75) Inventor: Chun-Hsiang Chiang, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/853,387

(22) Filed: May 25, 2004

(65) Prior Publication Data

US 2004/0259433 A1 Dec. 23, 2004

(30) Foreign Application Priority Data

May 27, 2003 (TW) ..... 92209724 U

(51) Int. Cl.[7] ..... H01R 9/09
(52) U.S. Cl. ..... 439/66
(58) Field of Search ..... 439/66, 862

(56) References Cited

U.S. PATENT DOCUMENTS 4,927,369 A * 5/1990 Grabbe et al. ..... 439/66
5,308,252 A * 5/1994 Mroczkowski et al. ..... 439/66
5,498,166 A * 3/1996 Rothenberger ..... 439/66
5,746,607 A * 5/1998 Bricaud et al. ..... 439/66
5,820,389 A * 10/1998 Hashiguchi ..... 439/66
6,604,950 B1 * 8/2003 Maldonado et al. ..... 439/66

* cited by examiner

*Primary Examiner*—Thanh-Tam Le
(74) *Attorney, Agent, or Firm*—Robert J. Zeitler

(57) ABSTRACT

An electronic connector includes an insulative housing having a plurality of terminal slots and a plurality of terminals received in the corresponding terminal slots. Each of the terminals includes a base having a top side and a bottom side, and both of the top side and the bottom side have a first end and a second end. A first elastic arm frontward extends from the first end of the top side and further laterally extends in a horizontal direction parallel to the top side toward the second end of the top side. A second elastic arm frontward extends from the first end of the bottom side and further laterally extends in a horizontal direction parallel to the bottom side toward the second end of the bottom side. The electronic connector of the present invention can effectively disperse pressing forces and improve an inserted stability of the terminal.

19 Claims, 5 Drawing Sheets

LGA CONNECTOR AND TERMINAL THEREOF

BACKGROUND OF THE INVENTION

1. Field of the Invention

The present invention relates to an electronic connector and its terminal, especially to an electronic connector and terminal thereof used in LGA packaging.

2. Description of Prior Art

LGA (Land Grid Array) is one of most common package for IC (Integrated circuit) or wafer. A LGA connector provides a solderless interconnection with a target PCB (Printed Circuit Board). Such an electronic connector adapted to a LGA package generally comprises an insulative housing, wherein has a plurality of cutouts, in which a plurality terminals are mounted respectively. Each terminal has a pair of electronic contacts for electrically connecting with a CPU (Central Processing Central) and a PCB respectively. And, both of a bottom surface of the CPU and an upper surface of the PCB are respectively provided a plurality of pads to implement electronic interconnection with the electronic contacts of the terminal without solder.

Factors must be considered in design of the terminals of such an electronic connector include:

1. Dispersing pressing forces to make the pressing forces as small as possible, otherwise, the pressing forces is liable to make the terminal deformed. Furthermore, it causes the terminal unable to be secured in a corresponding inserting slot.

2. Improving the mounting stability of the terminals in the cutouts: because the electronic interconnection between the CPU and the target PCB is implemented by electronic contacts of the terminals, the unreliable mounting of any terminal may cause bad contact condition, open circuit or short circuit.

Thus, a new electronic connector that satisfies the above-mentioned design needs is desired.

SUMMARY OF THE INVENTION

An object of the present invention is to provide an electronic connector and a terminal structure thereof that can effectively disperse pressing forces, and improve an inserted stability of the terminal.

To achieve the above object, an electronic connector in accordance with a preferred embodiment of the present invention comprises an insulative housing having a plurality of terminal slots and a plurality of terminals received in the corresponding terminal slots. Each of the terminals includes a base having a top side and a bottom side, and both of the top side and the bottom side have a first end and a second end. A first elastic arm frontward extends from the first end of the top side and further laterally extends in a horizontal direction parallel to the top side toward the second end of the top side. A second elastic arm frontward extends from the first end of the bottom side and further laterally extends in a horizontal direction parallel to the bottom side toward the second end of the bottom side.

Other objects, advantages, and novel features of the present invention will become more apparent from the following detailed description when taken in conjunction with the accompanying drawings, in which:

DETAILED DESCRIPTION OF THE INVENTION

Figure 1:
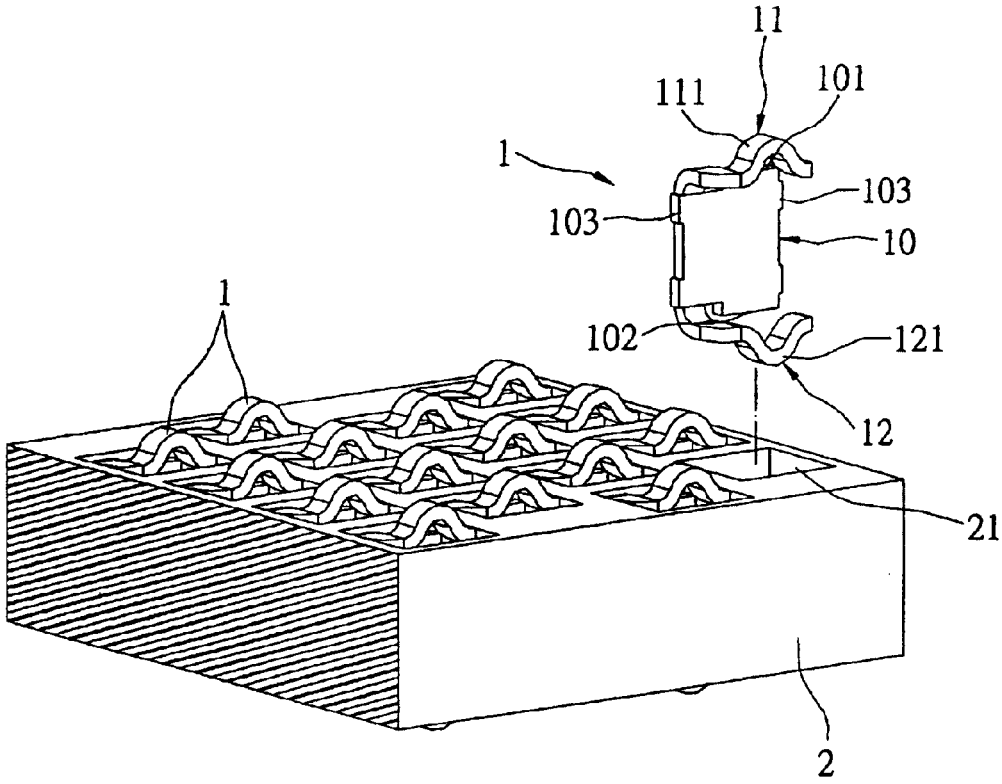
FIG. 1 is a partial, exploded perspective view of an electronic connector according to the present invention.
Figure 2:
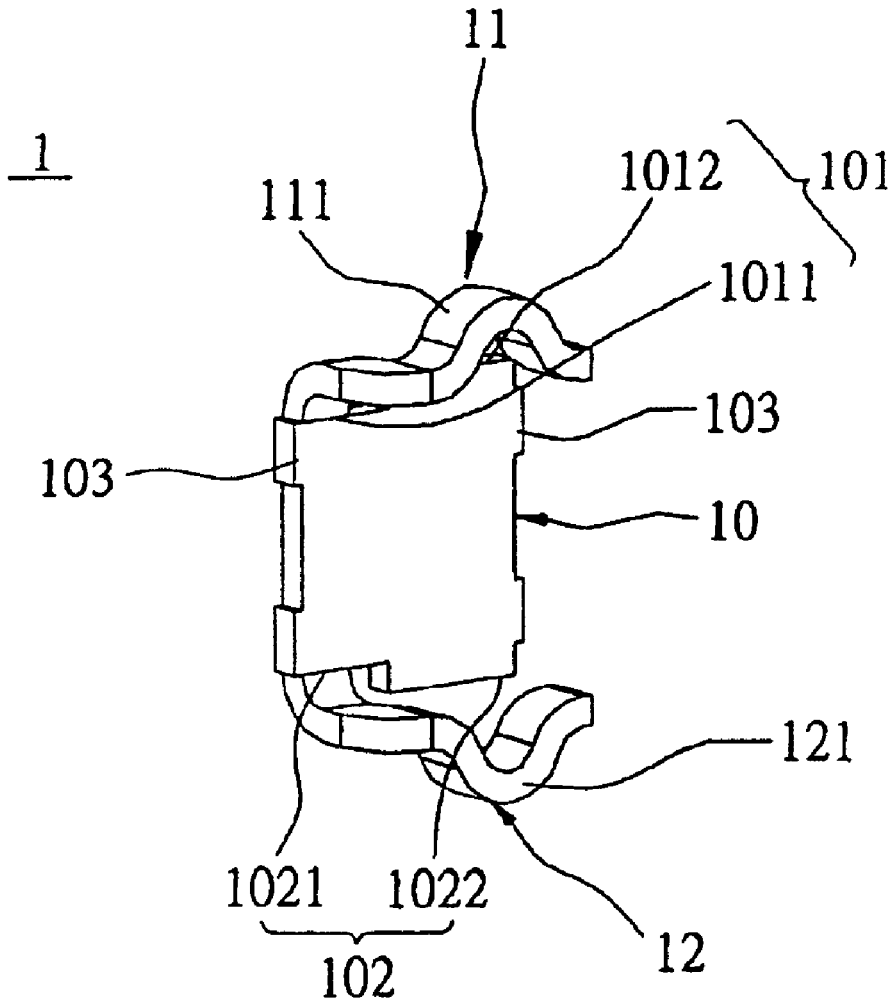
FIG. 2 is a perspective view of a terminal component of the electronic connector shown in FIG. 1.

FIGS. 1 and 2 show an electronic connector and a terminal structure thereof. The electronic connector comprises an insulative housing 2 and a plurality of terminals 1. The insulative housing 2 includes a plurality of terminal slots 21, and each of the plurality of terminals 1 is respectively receipted in the corresponding terminal slots 21.

Each of the plurality of terminal 1 comprises a base 10, a first elastic arm 11 and a second elastic arm 12. The base 10 includes four sides: a top side 101, a bottom side 102, a right side (not labeled) and a left side (not labeled). The top side 101 has a first end 1011 and a second end 1012. The bottom side 102 has a first end 1021 and a second end 1022. The first elastic arm 11 frontward extends from the first end 1011 of the top side 101 and further laterally extends toward the second end 1012 of the top side 101 in a horizontal direction parallel to the top side 101. The second elastic arm 12 frontward extends from the first end 1021 of the bottom side 102 and further laterally extends toward the second end 1022 of the bottom side 102 in a horizontal direction parallel to the bottom side 102.

In this embodiment, the top side 101 and the bottom side 102 of the base 10 are defined face-to-face with each other. Thus, the laterally extending direction of the first elastic arm 11 is same with that of the second elastic arm 12 because they respectively protrudes from the first end 1011, 1021 of the corresponding top side 101/ the bottom side 102. The first elastic arm 11 further comprises an upwardly protruding portion 111, and the second elastic arm 12 further comprises a downwardly protruding portion 121.

Figure 3:
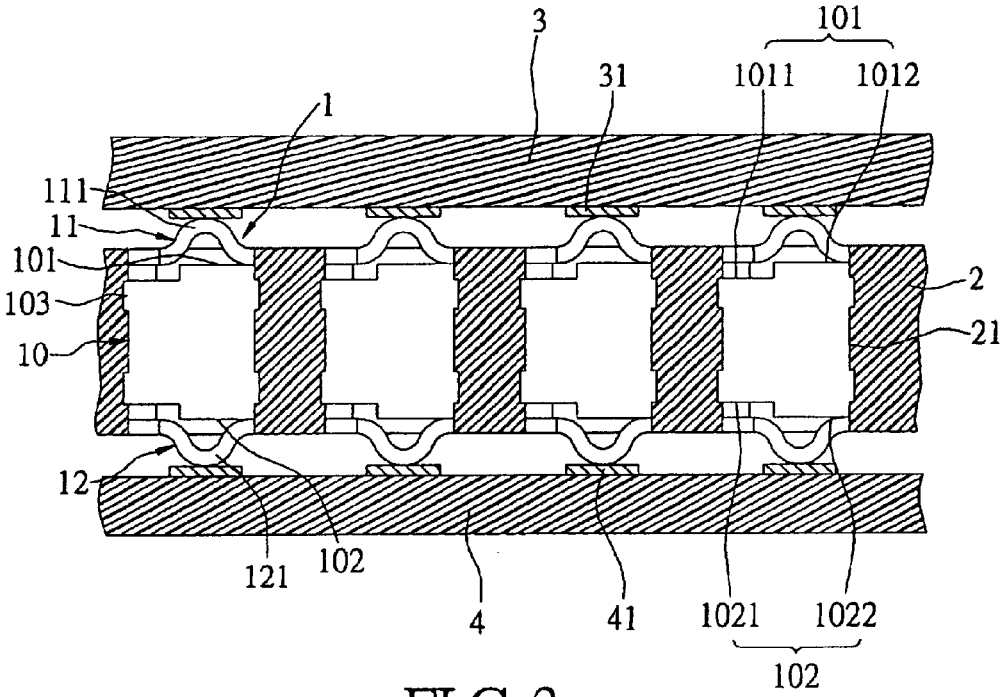
FIG. 3 is a front cross-sectional view illustrating the electronic connector electrically connecting with a CPU and a PCB.
Figure 4:
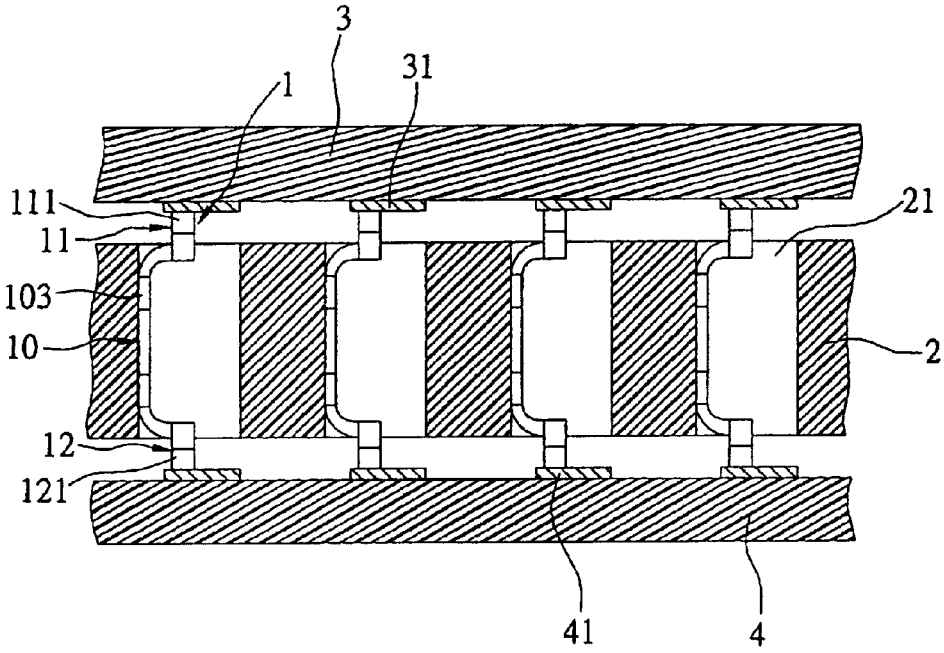
FIG. 4 is a right cross-sectional view of the assembly shown in FIG. 3.

Referring to FIGS. 3 and 4, after the terminal 1 had respectively inserted in the corresponding terminal slot 21, one side of the base 10 is pressed close against a corresponding inner side of the terminal slot 21. The base 10 further defines interference portions 103 adjacent to other inner sides of the terminal slot 21 in order to produce an interference function with the inner wall of the corresponding terminal slot 21, furthermore, in order to make the terminal 1 securely receipted in. The height of the base 10 is less or equal to that of the terminal slot 21, the first elastic arm 11 extends beyond an upper surface of the terminal slot 21 and the second elastic arm 12 extends beyond a bottom surface of the terminal slot 21, and an electronic connector of the present invention is formed by this way.

Referring to FIG. 3 and FIG. 4, there have a CPU 3 and a PCB 4 that are adapted for electrically connecting with the electronic connector of the present invention. The CPU 3 provides a plurality of electronic pads 31 on a bottom surface thereof, and the PCB 4 also provides a plurality of electronic pads 41 on an upper surface thereof. Both of the electronic pads 31, 41 are located corresponding to cutouts 21 of the insulative housing 2. In assembly, when the CPU 3, the electronic connector of the present invention and the PCB 4 are pressured upon together, the first and second elastic portions 14, 15 of the terminal 1 can elastically contact with the electronic pads 31, 41 respectively, which implement electronic interconnection between the CPU 3 and PCB 4 by LGA package manner.

Figure 5:
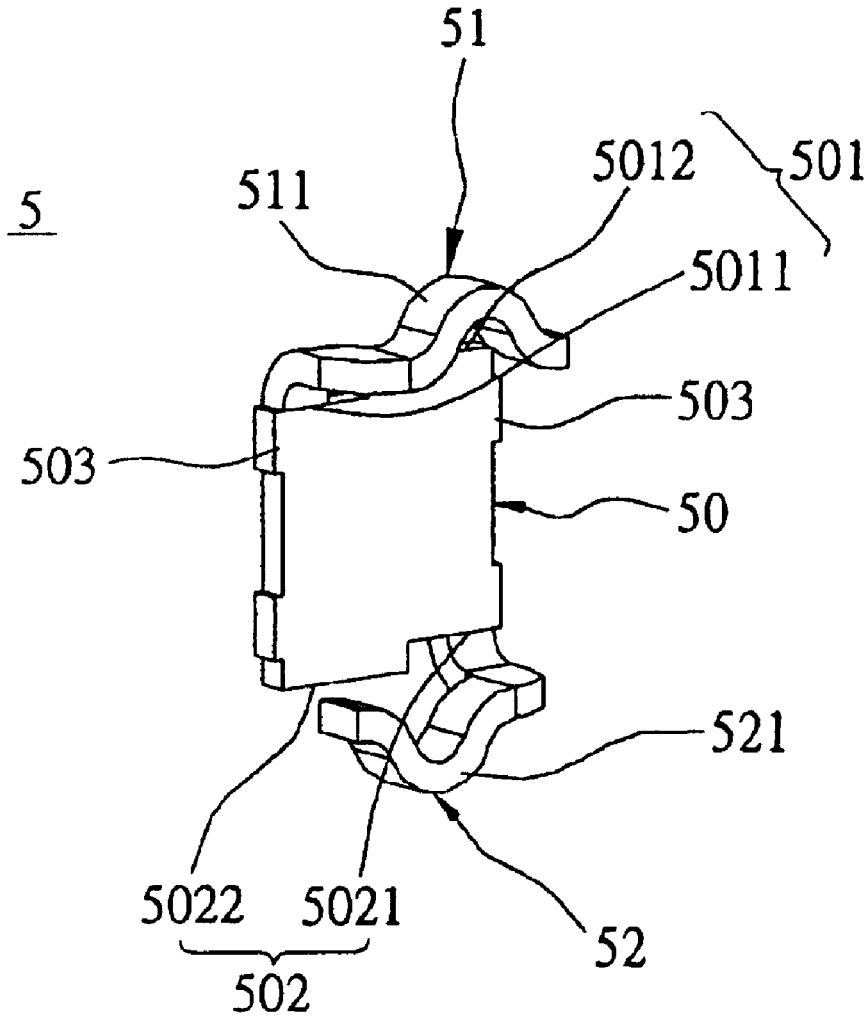
FIG. 5 is an perspective view of another embodiment of the terminal component of the electronic connector according to the present invention.

FIG. 5 is a perspective view of another embodiment of a terminal component 5 of the electronic connector according to the present invention. The terminal 5 also comprises a base 50, a first elastic arm 51 and a second elastic arm 52. The elastic arms 51, 52 also respectively protrude from a top side 51 and a bottom side 52 of the base 50. The elastic arm 51 also comprises an upwardly protruding portion 511, and the elastic arm 52 also comprises a downwardly protruding portion 521. The base 50 also defines interference portions 503 on right and left sides thereof. On the whole, the terminal 5 is similar as the terminal 1 shown in FIG. 2, the difference therebetween is: a first end 5011 of the top side 501 is defined correspondingly to a second end 5022 of the bottom side 502, and a second end 5012 of the top side 501 is defined correspondingly to a first end 5021 of the bottom side 502. As a result, the fist elastic arm 51 that protrudes from the first end 5011 and the first elastic arm 52 that protrudes from another first end 5021 have opposite laterally extending directions. In other words, the laterally extending direction of the first elastic arm 51 is opposite to that of the second elastic arm 52. Although the elastic arms 11, 12 of the terminal 1 and the elastic arms 51, 52 of the terminal 5 have different laterally extending directions, both of them are able to achieve the objections of the invention.

In use, the terminal 1 (or 5) is able to withstand pressured forces without deformation because two laterally extending elastic arms 11, 12 defined thereon can disperse the pressured force to two lateral sides of the base 10 thereof. Furthermore, even the terminal 1 (or 5) have been deformed, it still easy to reliably retained in the corresponding cutout 21 of the insulative housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

REFERENCE NUMERAL

| | | | |
|---|---|---|---|
| Terminal | 1, 5 | Base | 10, 50 |
| Interference portion | 103, 503 | Top side | 101, 501 |
| Bottom side | 102, 502 | | |
| First elastic arm | 11, 51 | Second elastic arm | 12, 52 |
| Protruding portion | 111, 121, 511, 521 | Insulative housing | 2 |
| Terminal slot | 21 | CPU | 3 |
| Electronic contact | 31, 41 | PCB | 4 |
| First end | 1011, 1021, 5011, 5021 | | |
| Second end | 1012, 1022, 5012, 5022 | | |

What is claimed is:

1. An electronic connector, comprising:

an insulative housing with a plurality of terminal passageways, and a plurality of terminals received in the corresponding terminal passageways, respectively, each of the terminals including:

a base having a top side and a bottom side, each of the top side and the bottom side having a first end and a second end;

a first elastic arm extended from the first end of the top side in a direction away from the base and further laterally extended in a horizontal direction parallel to the top side toward the second end of the top side;

a second elastic arm extended from the first end of the bottom side in a direction away from the base and further laterally extended in a horizontal direction parallel to the bottom side toward the second end of the bottom side;

wherein the base is located in a first plane, and the first elastic arm and the second elastic arm are located in a second plane, the first and second plane being generally parallel to each other and being offset from each other in a lateral direction.

2. The electronic connector as claimed in claim 1, wherein the first elastic arm further comprises an upwardly protruding portion, the second elastic arm further comprising a downwardly protruding portion.

3. The electronic connector as claimed in claim 1, wherein the laterally extending direction of the first elastic arm is same with that of the second elastic arm.

4. The electronic connector as claimed in claim 1, wherein the laterally extending direction of the first elastic arm is opposite to that of the second elastic arm.

5. The electronic connector as claimed in claim 1, wherein the height of the base is equal to that of the corresponding terminal passageway, the first elastic arm extending beyond an upper surface of the corresponding terminal passageway and the second elastic arm extending beyond a bottom surface of the corresponding terminal passageway.

6. The electronic connector as claimed in claim 1, where the height of the base is less than to that of the corresponding terminal passageway, the firs elastic arm extending beyond an upper surface of the corresponding terminal passageway and the second elastic arm extending beyond a bottom surface of the corresponding terminal passageway.

7. The electronic connector as claimed in claim 1, wherein the base defines an interference portion on a side thereof adjacent to an inner side of the corresponding terminal passageway.

8. A terminal structure, comprising:

a base having a top side and a bottom side, each of the top side and the bottom side having a first end and a second end;

a first elastic arm extended from the first end of the top side in a direction away from the base and further laterally extended in a horizontal direction parallel to the top side toward the second end of the top side;

a second elastic arm extended from the first end of the bottom side in a direction away from the base and further laterally extended in a horizontal direction parallel to the bottom side toward the second end of the bottom side;

wherein the base is located in a first plane, and the first elastic arm and the second elastic arm are located in a second plane, the first and second plane being generally parallel to each other and being offset from each other in a lateral direction.

9. The terminal structure as claimed in claim 8, wherein the first elastic arm further comprises an upwardly protruding portion, the second elastic further comprising a downwardly protruding portion.

10. The terminal structure as claimed in claim 8, wherein the laterally extending direction of the first elastic arm is same with that of the second elastic arm.

11. The terminal structure as claimed in claim 8, wherein the laterally extending direction of the first elastic arm is opposite to that of the second elastic arm.

12. The terminal structure as claimed in claim 8, wherein the base defines an interference portion on a side thereof adjacent to an inner side of the corresponding terminal passageway.

13. An electronic assembly, comprising:

a printed circuit board;

an integrated circuit package; and an electrical connector, wherein the electrical connector includes an insulative housing with a plurality of terminal passageways, and a plurality of terminals received in the corresponding terminal passageways, respectively, each of the terminals including:

a base having a top side and a bottom side, each of the top side and the bottom side having a first end and a second end;

a first elastic arm extended from the first end of the top side in a direction away from the base and further laterally extended in a horizontal direction parallel to the top side toward the second end of the top side;

a second elastic arm extended from the first end of the bottom side in a direction away from the base and further laterally extended in a horizontal direction parallel to the bottom side toward the second end of the bottom side;

wherein the base is located in a first plane, and the first elastic arm and the second elastic arm are located in a second plane, the first and second plane being generally parallel to each other and being offset from each other in a lateral direction.

14. The electronic assembly as claimed in claim 13, wherein the first elastic arm further comprises an upwardly protruding portion, the second elastic arm further comprising a downwardly protruding portion.

15. The electronic assembly as claimed in claim 13, wherein the laterally extending direction of the first elastic arm is same with that of the second elastic arm.

16. The electronic assembly as claimed in claim 13, wherein the laterally extending direction of the first elastic arm is opposite to that of the second elastic arm.

17. The electronic assembly as claimed in claim 13, wherein the height of the base is equal to that of the corresponding terminal passageway, the first elastic arm extending beyond an upper surface of the corresponding terminal passageway and the second elastic arm extending beyond a bottom surface of the corresponding terminal passageway.

18. The electronic assembly as claimed in claim 13, where in the height of the base is less than to that of the corresponding terminal passageway, the first elastic arm extending beyond an upper surface of the corresponding terminal passageway an the second elastic arm extending beyond a bottom surface of the corresponding terminal passageway.

19. The electronic assembly as claimed in claim 13, wherein the base defines an interference portion on a side thereof adjacent to an inner side of the corresponding terminal passageway.

* * * * *